United States Patent [19]

Deal

[11] 4,217,212

[45] Aug. 12, 1980

[54] METHOD OF PUMPING AND PROCESSING PHOSPHATE SLIME FOR LAND RECLAMATION

[76] Inventor: Troy M. Deal, P.O. Box 3348, Orlando, Fla. 32802

[21] Appl. No.: 916,584

[22] Filed: Jun. 19, 1978

[51] Int. Cl.[3] ..... C02F 1/34

[52] U.S. Cl. ..... 210/19; 210/49; 210/DIG. 29; 406/49; 406/144; 37/61; 37/66; 405/129

[58] Field of Search ..... 406/49, 53, 56, 144; 405/128, 129; 37/66, 61; 299/4, 5, 17, 7; 166/267; 210/1, 42 R, 46, 49, 59, 65, 70, 83, 84, 19, 137, 170, DIG. 29, 242 R

[56] References Cited

U.S. PATENT DOCUMENTS

| | | | |
|---|---|---|---|
| 740,731 | 10/1903 | Beatey | 299/17 |
| 2,019,968 | 11/1935 | Holloway | 406/144 |
| 2,353,602 | 7/1944 | Trotter | 210/19 |
| 3,493,496 | 2/1970 | Bray | 210/137 |
| 3,680,698 | 8/1972 | Liu | 210/46 |
| 3,707,523 | 12/1972 | Ledden | 210/DIG. 27 |
| 3,763,041 | 10/1973 | Cook | 210/42 R |
| 3,779,384 | 12/1973 | Stahlkopf | 210/137 |
| 3,967,393 | 7/1976 | Nixon | 210/170 |
| 3,971,148 | 7/1976 | Deal | 37/66 |
| 4,036,752 | 7/1977 | Lassiter | 210/46 |
| 4,038,183 | 7/1977 | Davidtz | 405/128 |
| 4,104,813 | 8/1978 | Lindsey | 37/66 |

OTHER PUBLICATIONS

Building Land with Phosphate Wastes, Mining Engineering, Dec. 1969, pp. 38–40.

*Primary Examiner*—Ernest G. Therkorn
*Attorney, Agent, or Firm*—Beaman & Beaman

[57] ABSTRACT

The invention relates to the broad subject of dewatering phosphate clay wastes and has for its primary object the drainage of existing phosphate slime settling ponds and the reclamation of the drained ponds through the use of the processed slime as a land fill having adequate drainage characteristics.

Another object of the invention is to provide a processing step for phosphate slimes which will reduce the environmental impact of mining phosphate to an acceptable level.

4 Claims, 6 Drawing Figures

METHOD OF PUMPING AND PROCESSING PHOSPHATE SLIME FOR LAND RECLAMATION

BACKGROUND OF THE INVENTION

Natural phosphate rock has been extensively mined, particularly in the State of Florida, and converted into a useful fertilizer. See U.S. Pat. Nos. 630,395; 740,731 and 1,901,221. This mining activity has resulted in thousands of acres being wasted in the form of presently existing phosphate slime settling ponds which have defied drainage as well as use of the waste as land fill.

An investigation of the patented art failed to locate disclosures specifically concerned with the problem involved in the pumping and processing of phosphate slime in settling ponds. However, a great deal of research has been devoted to the dewatering of phosphate slimes. Reference is made to the January 1973–February 1977 Technical Status Report on the subject of Dewatering of Phosphatic Clay Wastes by the Center for Research in Mining and Mineral Resources, Department of Materials, Science and Engineering, College of Engineering, University of Florida, Gainesville, Florida.

SUMMARY OF THE INVENTION

Primarily, the invention relates to a method capable of pumping such semi-liquids as phosphate slime found in existing settling ponds. In addition to making it possible to pump such material in commercial volumes, the method involves the further step of scrubbing or mixing the material in transit to modify the form of the slime so as to dewater the same by seepage to a concentrate in the order of 30% solids so as to be useable in land reclamation as a fill.

Although the pump may be located above the surface of the pond, it is preferably immerged in the pond and moved along the bottom to maintain the highest possible head on the pump inlet and to facilitate any tendency the slimes may have to flow toward the inlet. A combination pressure and flotation chamber preferably embraces the pump mechanical conveying means, such as power rotated augers, and provided for forcing the slime into the combination chamber to pressurize the same. Preferably the chamber has some form of movable wall which resist the buildup of pressure in the chamber by the material being moved by the conveying means. In practice the movable wall may take the form of an inflated bladder means or the like acting to reduce surges through the chamber and pump and providing pressure storage. By reversing the direction of rotation of the augers and increasing the inflation of the bladder to substantially empty the pressure chamber, it becomes a flotation chamber facilitating the movement of the apparatus in the pond.

Preferably, the pressure level in the chamber embracing or communicating with the pump inlet is utilized to control the rate of rotation of the augers. For example movement of the bladder in opposite directions may be used to actuate suitable controls associated with the auger drive mechanism located at the surface of the pond.

Movement of the material through the pump is preferably by positive or centrifugal displacement in the pump casing in combination with the force feeding action of the pressure chamber and the mechanical conveying means associated therewith.

Movement of the semi-liquid material between the immerged pump associated with the pressure chamber and the surface located transmission pump is preferably boosted by a suitable water actuated venturi pump injection system which also serves to control the density or percentage of solids of the phosphate slime and water mixture. The injecting system may be controlled by a suitable density sensor and associated control mean for automatically retaining the density in an acceptable range.

In order to modify the form of the slime to effect dewatering by seepage or the like to a concentrate in the order of 30% solids for land fill purposes, the slime is mixed with scrubbing material in the form of water and an abrasive such as sand, sand tailings, mine tailings and the like, up stream from the transmission pump. The scrubbing and mixing action which takes place in the transmission pump and transit pipe modifies and breaks down the physical make up of the slime to facilitate dewatering by seepage or the like.

The auger structure may embody some of the structural and functional characteristics of my U.S. Pat. No. 3,971,148. That portion of each auger directly adjacent the combination pressure and flotation chamber will be confined within a housing section with a close running clearance in order for the auger to pressurize the chamber with the semi-liquid material. Preferably that portion of the auger directly adjacent the inlet end of the housing section will have debris ejector elements to screen the material moving along the auger toward the inlet end of the housing section. The cleaning projections shown in my U.S. Pat. No. 3,971,148 are omitted from the auger area swept by the debris ejector elements as well as from that portion of the auger located in the housing sections.

DESCRIPTION OF THE PREFERRED EMBODIMENT

Figures 1, 2:
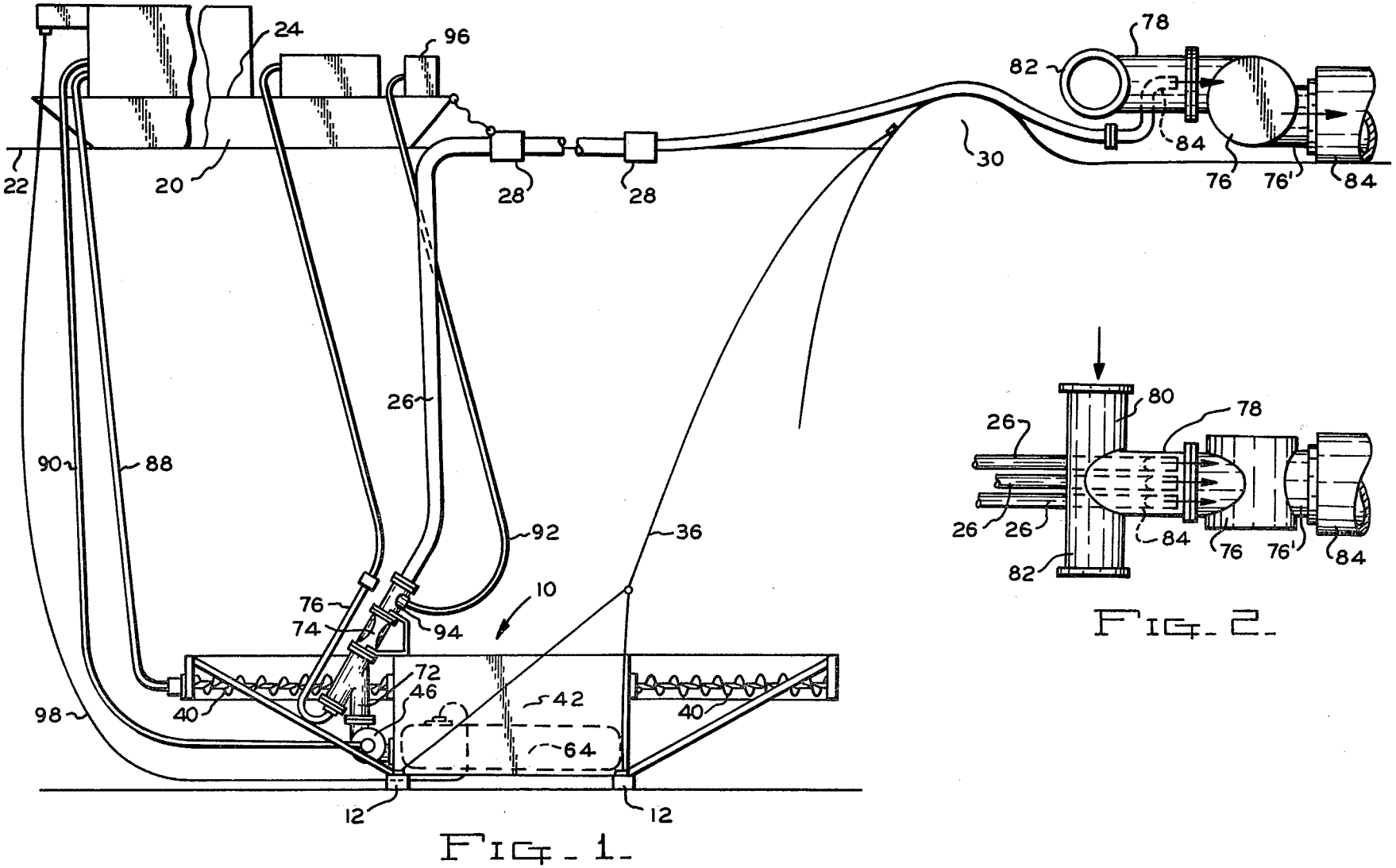
FIG. 1 is a schematic view of apparatus in site for carrying out the method.
FIG. 2 is a plan view of a portion of the apparatus shown in elevation in FIG. 1.
Figure 3:
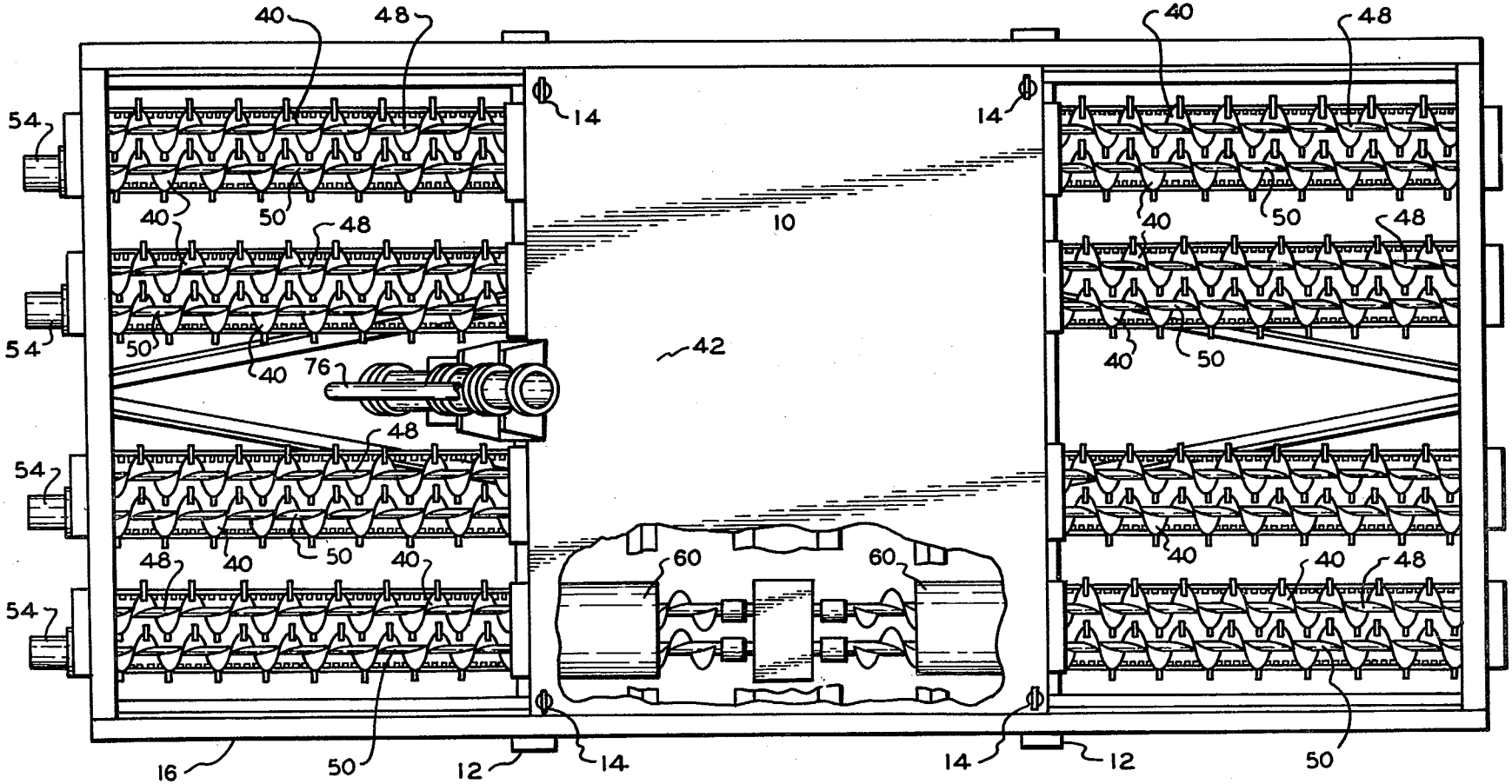
FIG. 3 is a plan view of the force feed pumping structure with a section of the pressure chamber shown broken.
Figure 4:
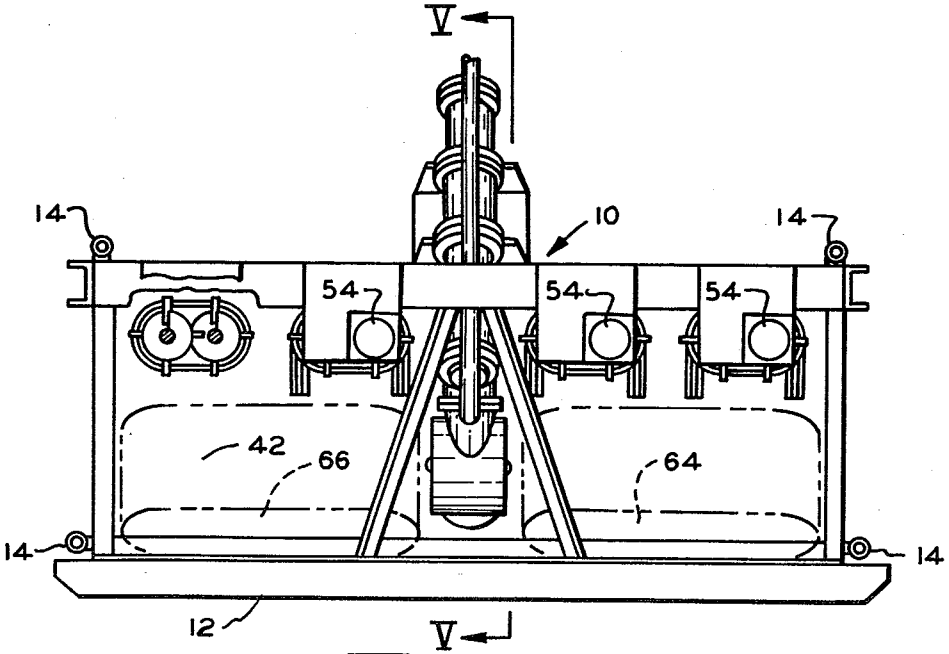
FIG. 4 is an end view of FIG. 3.

Referring to FIG. 1, force feed pumping apparatus 10 is shown supported on runners 12. Lifting and towing eyes 14 are provided at opposite ends of the frame work 16 for raising and lowering the apparatus 10 and for towing the same along the bottom 18 of the settling pond for the phosphate slimes. A barge 20 is shown on the surface 22 of the pond to provide a surface platform 24 for the power supply to the augers and pumps and the controls therefore as well as the inflation means for the bladder means and the various sensor and pressure gauges for regulating density and buoyancy.

A flexible transmission pipe 26 communicating with the force feed pumping apparatus 10 at the bottom 18 of the pond, is supported by suitable floats 28 and extends to the edge 30 of the pond where the transmission pump is located and connected to the pump transmission. In practice, in lieu of towing the apparatus 10 by a cable 36 extending to the shore 30 of the pond, the apparatus 10 may be supported from a dredge boom carried on a barge or otherwise projected over the pond surface.

To be commercially practical, the pumping capacity of the apparatus 10 must be relatively great. To that end a large number of augers 40 are required to assure sufficient movement of the semi-liquid phosphate slimes material into the pressure chamber 42 to avoid surges of material and to maintain a uniform high volume flow of material under pressure to the inlet 44 of the pump 46. As illustrated, four pair of reversible self-cleaning auger 40 are disposed on opposite sides of the pressure chamber 42. The drive shafts 48 and 50 of each pair of augers on one side of the chamber 42 are common to each pair on the opposite side with a common central bearing structure 52. Each pair of shafts 48 and 50 is driven by a hydraulic motor 54 in the manner more fully disclosed in U.S. Pat. No. 3,971,148.

As a departure from the disclosure of U.S. Pat. No. 3,971,148, the portions of the auger blades 56 projecting into the pressure chamber 42 are free of the self-cleaning projections 58 to enable the blades 56 to have a close running clearance within the housing sections 60 so as to provide force feeding of the phosphate slimes material into the pressure chamber 42. Debris ejectors 62 attached to and driven by the shafts 48 and 50 screen the movement of material into the inlet end of the housing sections 60.

A pair of suitable inflatable bladder means 64 and 66 are located within the pressure chamber 42. These inflatable bladders means have two functions. One is to provide a chamber having a yieldable movable wall in the broad sense to enable the chamber to act as an accumulator to provide a uniform rate of material flow to the inlet 44 of the pump 46 communicating with the interior of the pressure chamber 42. Normally the bladder means 64 and 66 will be in the inflated condition shown in full line in FIG. 5.

Figure 5:
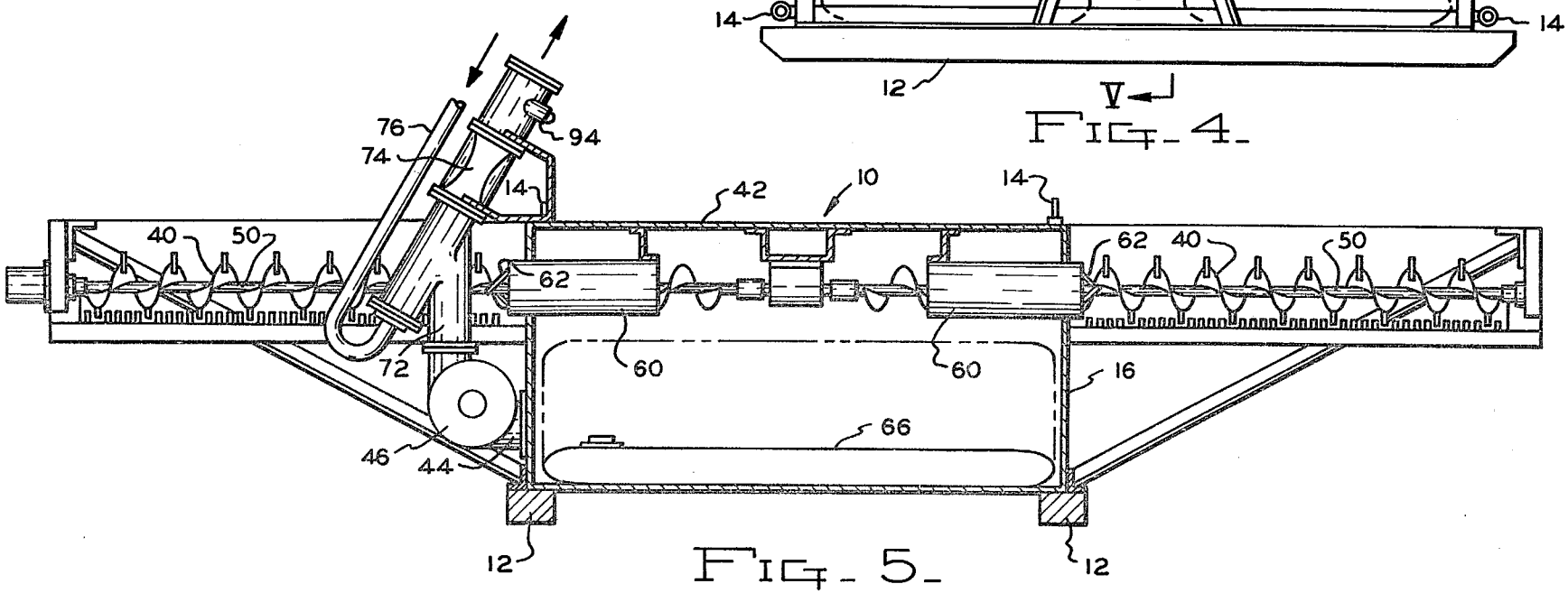
FIG. 5 is a cross sectional view taken on line V—V of FIG. 4.
Figure 6:
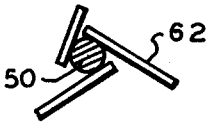
FIG. 6 is an enlargement of a portion of FIG. 4 showing the debris ejectors on the augers.

When the force feed pumping apparatus 10 is to be moved to a new position on the pond bottom 18, the augers 40 are reversed and the bladder means 64 and 66 are inflated to the full line position shown in FIG. 5 to substantially empty the chamber 42 of material and to substantially increase the buoyancy of the chamber 42 and associated structure making it easier to move the apparatus 10 into a new position.

The pump 46 is preferably a positive or centrifugal displacement type with its outlet 72 having a Y-connection with a jet venturi injector pump 74, the line 76 conducting water under pressure to the injector pump. A density meter transmitter is located at the outlet of the pump 74 to provide a continuous reading at the surface platform, the water jet acting to boost the material discharged by the pump 46 and to regulate the density by dilution being pumped to the surface through the flexible transmission pipe 26.

In practice, a plurality of pipes 26 from a corresponding number of force feed pumping apparatus 10 will extend to a common large centrifugal transmission pump 76, preferably located on the shore of the pond. As shown in FIG. 2, the pump 76 has T-shaped inlet 78 with water being directed through the branch 80 and sand, sand tailings, mine tailings and the like being directed through the branch 82. The pipes 26 connect with nozzles 84 in the inlet 78 to direct the phosphate slimes down stream in injection relation with the abrasive solution provided by the branches 80 and 82.

At the time the phosphate slimes are first mixed with the abrasive solution flowing into the inlet 78 of the pump 76, the slimes have a high percentage of entrained water which does not lend itself to drainage and evaporation to enable the slimes to be used as a land fill. However the scrubbing and mixing activity which takes place in the pump 76 as well as in the pipe transmission 84 connected to the outlet 76' appears to modify the form of the slimes whereby drainage and evaporation of water will normally result in the slimes being concentrated in the order of 30% solids and adequate density for land fill purposes.

In FIG. 1 the hydraulic power lines 88 and 90 extend between the surface platform 24 and the auger pumps 40 and pump 46 respectively. Cable 92 extends between the density transmitter 94 and a density receiver 96 on the surface platform 24. An air line 98 with suitable gauge means extends between the surface platform and the bladder means 64 and 66.

When the phosphate content of the slimes warrants reprocessing to recover the phosphate, the abrasive solution with the resulting scrubbing may be omitted and the phosphate slime pumped directly to the reprocessing plant. However, the dewater improvements provided by the abrasive solution may be helpful in the recovery process.

Where the density of the phosphate slimes resist substantial movement by gravity into the working zone of the augers 40, the pond area directly embracing the apparatus 10 may be vibrated by suspending steel beams or the like from the surface platform 24 and employing suitable vibration means to impart the necessary input into the suspended beams to cause a flow of phosphate slimes material into the void of the working area of the augers 40.

When the slimes to be transferred from an existing settling pond are not to be processed to recover the phosphate present, the mixture of slimes, water and sand tailings may be pumped directly into the mining cuts. Such cuts are usually from 150–350' in width and 50' to 70' in depth and may range to a mile or more in length. The mixture may have a density in the order of 25–40% solids or less depending upon the amount of sand tailings required to effectively dewater the slimes being handled by the pumping and transmission apparatus. Within a relatively short period, the processed slimes in the mixture will be dewatered by seepage in the mining cuts.

To improve the fertility of the land fill of the mining cut, the adjacent overburden may be spread over the dewatered slimes. Also, it is anticipated that the slimes pumped from one existing settling pond may be processed as herein disclosed and returned as fill to a previously pumped existing settling pond.

By modifying the colloidal-like state in which the slimes exist in the settling pond through the pumping and transmission apparatus of the present invention and the slurrified mixture of sand tailings, water and slimes, the dewatering of the slimes by seepage or other forms of filtration has been substantially accelerated with a resulting solid content in the order of 30% or more being obtainable under most conditions in a relatively short period as compared with the use of the conventional settling pond.

The debris ejectors 62 associated with each shaft 48 and 50 adjacent the inlet end of the housings 60 may be in the form of radial rods spaced 120° apart and of different length. The rods are inclined toward the housings 60 with the shortest rod on one shaft having working clearance with the longest rod on the adjacent shaft. In this manner the inlets to the housings 60 is effectively swept by the rod to prevent debris from entering.

I claim:

1. A method of reclaiming land and reducing the environmental impact of mining phosphate rock which involves the pumping of semi-liquid phosphate slimes from settling ponds while simultaneously modifying the form of the slimes to facilitate dewatering comprising the following steps:

(a) moving the slimes toward the inlet of a pump by mechanical means, the inlet communicating with a pressure chamber, (b) pressurizing the chamber by the movement of said slimes from the pond into said chamber, (c) controlling the rate of slimes movement by said means into said chamber by means responsive to the pressure in said chamber, (d) exerting a positive pumping force on said slimes by said pump to move said slimes from said chamber through said inlet toward a transmission pump and associated pipe structure, (e) boosting the efforts of said first pump by water injection with an accompanying dilution of the density of said slimes between said pumps, and (f) scrubbing the diluted slimes to modify the form of the slimes by mixing the diluted slimes with an abrasive mixture upstream from said transmission pump.

2. A method as defined in claim 1 wherein the means of step (a) involves vibration.

3. A method of pumping and processing a phosphate slime stored in a settling pond to modify the colloidal form to improve dewatering of the slime by seepage or other form of filtration comprising the following steps:

(a) locating the inlet and outlet of a first pump below the surface of the pond, (b) forcing the slime by mechanical means into the inlet of said first pump, (c) connecting the outlet of said first pump with the inlet of a second pump by a first conduit, (d) diluting the slime and assisting its movement in said first conduit by a venturi pump located in said first conduit, (e) directing an abrasive slurry into the inlet of said second pump to further dilute said slime and to mix with and scrub said slime in said second pump, (f) and continuing the mixing and scrubbing of the slime in a second conduit connected to the outlet of said second pump while transmitting said slime to its point of discharge for dewatering.

4. A method of reclaiming land and reducing the environmental impact of mining phosphate rock which involves the pumping of semi-liquid phosphate slimes from settling ponds while simultaneously modifying the form of the slimes to facilitate dewatering comprising the following steps:

(a) moving the slimes toward the inlet of a pump by mechanical means, the inlet communicating with a pressure chamber, (b) pressurizing the chamber by the movement of said slimes from the pond into said chamber, (c) controlling the rate of slimes movement by said means into said chamber by means responsive to the pressure in said chamber, (d) exerting a positive pumping force on said slimes by said pump to move said slimes from said chamber through said inlet toward a transmission pump and associated pipe structure, (e) diluting the slimes, and (f) scrubbing the diluted slimes to modify the form of the slimes by mixing the slimes with an abrasive mixture upstream from said transmission pump.

* * * * *